US005594534A

United States Patent [19]

Genovese

[11] Patent Number: 5,594,534

[45] Date of Patent: Jan. 14, 1997

[54] ELECTRODED DONER ROLL STRUCTURE INCORPORATING RESISTIVE NETWORK

[75] Inventor: Frank C. Genovese, Fairport, N.Y.

[73] Assignee: Xerox Corporation, Stamford, Conn.

[21] Appl. No.: 585,078

[22] Filed: Jan. 11, 1996

[51] Int. Cl.[6] ..... G03G 15/08

[52] U.S. Cl. ..... 399/285

[58] Field of Search ..... 355/259, 262, 355/247; 118/648, 654

[56] References Cited

U.S. PATENT DOCUMENTS

| | | | |
|---|---|---|---|
| 3,257,224 | 6/1966 | Jons | 117/17.5 |
| 3,980,541 | 9/1976 | Aine | 204/186 |
| 3,996,892 | 12/1976 | Parker et al. | 118/658 |
| 4,868,600 | 9/1989 | Hays et al. | 355/259 |
| 5,172,170 | 12/1992 | Hays et al. | 355/259 |
| 5,268,259 | 12/1993 | Sypula | 430/311 |
| 5,289,240 | 2/1994 | Wayman | 355/259 |
| 5,339,142 | 8/1994 | Hays | 355/259 |
| 5,394,225 | 2/1995 | Prker | 355/245 |
| 5,473,414 | 12/1995 | Thompson | 355/200 |
| 5,504,563 | 4/1996 | Hays | 355/261 |
| 5,515,142 | 5/1996 | Rommelmann | 355/259 |
| 5,517,287 | 5/1996 | Rodriguez et al. | 355/259 |
| 5,539,505 | 7/1996 | Parker | 355/259 |

FOREIGN PATENT DOCUMENTS

| | | | |
|---|---|---|---|
| 3-189650 | 8/1991 | Japan | 355/262 |

*Primary Examiner*—R. L. Moses
*Attorney, Agent, or Firm*—John S. Wagley

[57] ABSTRACT

A donor roll for transporting marking particles to an electrostatic latent image recorded on a surface is provided. The donor roll is adaptable for use with an electric field to assist in transporting the marking particles from the donor roll to a development zone adjacent the surface. The donor roll includes a rotatably mounted body and a first electrode member mounted on the body. The donor roll further includes a second electrode member mounted on the body and spaced from the first electrode member and a resistive member electrically interconnecting the first electrode member and the second electrode member so that when an activation potential for creating an electric field is applied to the first electrode member a portion of the potential will be transferred to the second electrode member creating an attenuated field.

24 Claims, 11 Drawing Sheets

| RESISTOR RATIO | MAX FIELD GRADIENT V/MIL |
|---|---|
| r=.05 | 11.5 |
| r=.08 | 14.4 |
| r=.1 | 15.8 |
| r=.15 | 18.8 |
| r=.2 | 21.1 |
| r=.4 | 27.2 |
| r=.6 | 31.2 |
| r=1.0 | 36.3 |

ELECTRODED DONER ROLL STRUCTURE INCORPORATING RESISTIVE NETWORK

The present invention relates to a developer apparatus for electrophotographic printing. More specifically, the invention relates to a donor roll as part of a scavengeless development process.

Cross reference is made to United States Application No. (D/95041), entitled "Donor Rolls with Capacitively Cushioned Commutation", by Delmer G. Parker et al. filed concurrently herewith.

In the well-known process of electrophotographic printing, a charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically charged powder known as "toner." Toner is held on the image areas by the electrostatic interaction between the toner charge and the charge on the photoreceptor surface. Thus, a toner image is produced in conformity with a light image of the original being reproduced. The toner image may then be transferred to a substrate or support member (e.g., paper), and the image affixed thereto to form a permanent record of the image to be reproduced. Subsequent to development, excess toner left on the charge retentive surface is removed from the surface. The process is useful for light lens copying from an original, or printing electronically generated or stored originals, such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey charged toner particles to the latent image at a controlled rate so that the toner particles adhere electrostatically to the appropriate areas on the latent image. A commonly used technique for development is the use of a two-component developer material, which comprises, in addition to the toner particles which are intended to adhere to the photoreceptor, a quantity of magnetic carrier beads. The toner particles adhere triboelectrically to the relatively large carrier beads, which are typically made of coated steel. When the developer material is placed in a magnetic field, the carrier beads with the toner particles thereon form what is known as a magnetic brush, wherein the carrier beads form relatively long chains which resemble the fibers of a brush. This magnetic brush is typically created by means of a "developer roll." The developer roll is typically in the form of a cylindrical sleeve rotating around a fixed assembly of permanent magnets. The carrier beads form chains or filaments extending from the surface of the developer roll, with the toner particles electrostatically attached to the carrier beads. When the magnetic brush is introduced into a development zone adjacent the electrostatic latent image on a photoreceptor, the electrostatic charge pattern on the photoreceptor will cause the toner particles to be detached from the carrier beads and selectively deposited on the photoreceptor surface.

Another known development technique involves a single-component developer, that is, a developer which consists entirely of toner. In a common type of single-component system, each toner particle has both an electrostatic charge (to enable the particles to be attracted and adhere to the photoreceptor) and magnetic properties (to allow the particles to be magnetically conveyed to the development zone). Instead of using magnetic carrier beads to form a magnetic brush, the magnetized toner particles are caused to adhere directly to a developer roll. In the development zone, where the roll surface is brought in close proximity to the electrostatic latent image on a photoreceptor, the electrostatic charge pattern in the image causes the toner particles to be attracted from the developer roll and selectively deposited on the photoreceptor surface.

An important variation to the general principle of development is the concept of "scavengeless" development. The purpose and function of scavengeless development are described more fully in, for example, U.S. Pat. Nos. 4,868,600 and 4,868,600 to Hays et al., which is hereby incorporated by reference. In one type of scavengeless development system, charged toner is detached from a donor roll by applying AC electric fields via self-spaced electrode structures, commonly in the form of wires positioned in the nip between the donor roll and photoreceptor surface. This forms a toner powder cloud in the nip and the latent image attracts charged toner from the powder cloud thereto. Because the toner is propelled to the photoreceptor surface solely by the electrostatic forces provided by the latent image and there is no other physical interaction between the development apparatus and the photoreceptor, scavengeless development is useful for imaging systems in which it is desirable to supply a succession of different types of toner onto a common photoreceptor surface, without disturbing toner already deposited or cross-contaminating the different toner supplies, such as in "tri-level"; "recharge, expose and develop"; "highlight"; or "image on image" color xerography.

A typical "hybrid" scavengeless development apparatus includes, within a developer housing, a transport roll, a donor roll, and an electrode structure. The transport roll advances a mix of carrier and toner to a loading zone adjacent the donor roll. The transport roll is electrically biased relative to the donor roll, so that the toner is attracted from the carrier and uniformly coats the donor roll. The donor roll advances toner from the loading zone to the development zone adjacent the photoreceptor surface. Stretched wires forming the electrode structure in the development zone are positioned in the nip between the donor roll and the photoreceptor surface. In the development zone, the electrode wires are energized with high voltage AC which creates strong alternating electric fields between the electrode wires and the donor roll surface that detaches toner therefrom and forms a toner powder cloud in the gap between the donor roll and the photoreceptor. The latent image on the photoreceptor selectively attracts charged toner particles from the powder cloud forming a toner powder image thereon.

Another variation on scavengeless development uses a single-component developer material. In a single component scavengeless development system, the donor roll and the electrode structure create a toner powder cloud in the same manner as the above-described scavengeless development technique, but instead of using a mix of carrier and toner, only toner is used.

It has been found that for some toner materials, the tensioned electrically driven wires in self-spaced contact with the donor roll are vibrationally unstable which causes non-uniform development. Furthermore, any debris momentarily lodging on the wire can cause streaking. Thus, it would appear to be advantageous to replace the externally located electrode wires with electrodes integral to the donor roll.

In U.S. Pat. No. 5,172,170 to Hays et al., there is disclosed an apparatus for developing a latent image recorded on a surface, including a housing defining a chamber storing at least a supply of toner therein, a moving donor member spaced from the surface and adapted to transport toner from the chamber of said housing to a development zone adjacent the surface, and an electrode member integral with the donor member and adapted to move therewith. The electrode member is electrically energized with high voltage AC which creates strong alternating electric fields at the donor surface. These fields detach toner from said donor member and form a cloud of charged toner particles in the space between the electrode member and the photoreceptor surface thereby providing a supply of charged toner for developing the latent image. Activation of electrodes in the development nip is typically accomplished by means of a conductive brush which is placed in a stationary position in contact with electrode commutation pads on the periphery of the donor member. The conductive brush is driven by an electrical power source. The brush is typically a conductive fiber brush made of pultruded fibers, or a solid graphite brush positioned so that only a limited number of electrodes in the nip between the donor member and the developing photoreceptor surface are electrically activated as the donor member rotates. Since the width of the nip is very narrow, it is impractical to position the conductive brush itself directly in the nip, so the donor member is usually extended beyond the development zone to allow space for the brush and commutation pad assembly. U.S. Pat. No. 5,172,170 is herein incorporated by reference.

Electrical commutation using a stationary conductive brush positioned in contact with a plurality of individual electrode elements on the periphery of the donor member has several practical limitations. Many materials have been considered for fabricating the contacting brush including metallic and non-metallic formulations. Carbon fiber brushes and solid graphite brushes have been found to be the most robust. A resistance graded carbon fiber brush constructed with low resistance fibers in the center of the brush and higher resistance fibers on the leading and trailing ends of the brush has been shown to improve performance by providing gradual rather than discontinuous electrical connection and disconnection between the brush and individual electrodes. The rubbing contact of the brush on the commutation pads causes mechanical wear which limits the life of the brushes and the donor roll in the contacting area. It has also been observed that abrupt electrical commutation creates electrical noise and promotes electrical breakdown and electro-chemical erosion at the contacting points. The abrupt breaking of contacts at random phases of the High voltage AC activation waveform has also been found to leave random residual charges on the electrodes which indirectly causes irregular density bands in the developed image. Power dissipated in the brushes and commutation losses both generate heat which can soften and agglomerate stray toner particles in the commutation path, thereby reducing development reliability and negatively affecting copy quality. Also, when a carbon fiber brush is used, the fibers wear away and can break off from the brush and provide short circuit paths to the high voltage supply. Furthermore, other forms of contamination, including paper and clothing fibers can become trapped by the brush causing premature failure. To reduce these modes of failure, complicated and expensive filtering systems may be required to remove the paper and clothing fiber as well as toner agglomerates and other contaminants from the toner supply. Electrical noise generated by commutation can also cause imaging and development artifacts which are detrimental to copy quality.

The following disclosures related to scavengeless and electroded rolls may be relevant to various aspects of the present invention:

- U.S. patent application Ser. No. 08/376,585 Applicant: Rommelmann et al. Filing Date: Jan. 23, 1995
- U.S. patent application Ser. No. 08/339,614 Applicant: Rommelmann Filing Date: Nov. 15, 1994
- U.S. Pat. No. 5,394,225 Patentee: Parker (Prker) Issue Date: Feb. 28, 1995
- U.S. Pat. No. 5,289,240 Patentee: Wayman Issue Date: Feb. 22, 1994
- U.S. Pat. No. 5,268,259 Patentee: Sypula Issue Date: Dec. 7, 1993
- U.S. Pat. No. 5,172,170 Patentee: Hays et al. Issue Date: Dec. 15, 1992
- U.S. Pat. No. 4,868,600 Patentee: Hays et al. Issue Date: Sep. 19, 1989
- U.S. Pat. No. 3,996,892 Patentee: Parker et al. Issue Date: Dec. 14, 1976
- U.S. Pat. No. 3,980,541 Patentee: Aine Issue Date: Sep. 14, 1976
- U.S. Pat. No. 3,257,224 Patentee: Jons et al. Issue Date: Jun. 21, 1966

Ser. No. 08/376,585 discloses an apparatus for transporting marking particles. The apparatus includes a donor roll and an electrode member. The electrode member includes a plurality of electrical conductors mounted on the surface of donor roll with adjacent electrical conductors being spaced from one another. The electrode member further includes a connecting member fixedly secured to the donor roll. The connecting member electrically interconnects at least two electrical conductors.

Ser. No. 08/339,614 discloses a donor roll for transporting marking particles to an electrostatic latent image recorded on a surface. The donor roll includes a body rotatable about a longitudinal axis and an electrode member. The electrode member includes a plurality of electrical conductors mounted on the body with adjacent electrical conductors being spaced from one another having at least a portion thereof extending in a direction transverse to the longitudinal axis of the body.

U.S. Pat. No. 5,394,225 discloses a donor roll which has of interdigitated conductive electrodes embedded in the surface. An optical switching arrangement is located between a slip ring contacted by a brush and one set of interdigitated electrodes. The optical switching arrangement includes a photoconductive strip.

U.S. Pat. No. 5,289,240 discloses a donor roll which has two distinct sets of electrodes along the periphery of the donor roll. The roll has a first set of electrodes that extend axially the length of the roll. The first set of electrodes includes groups of 1 to 6 electrodes which are electrically interconnected to each other and are commutated by contacting the filaments of a brush which is electrically interconnected to a biasing source. The roll also has a second set of electrodes that extend axially the length of the roll, are interconnected to each other, do not contact the brush, and are grounded.

U.S. Pat. No. 5,268,259 discloses a process for preparing a toner donor roll which has an integral electrode pattern. The process includes coating a cylindrical insulating member with a photoresistive surface, pattern exposing the photoresistive surface to light to form an electrode pattern and depositing conductive metal on the portion of the member exposed to light to form the electrode pattern.

U.S. Pat. No. 5,172,170 discloses a donor roll with a plurality of electrical conductors spaced from one another with each conductor located in a groove in the donor roll. A dielectric layer is disposed in at least the grooves of the roll interposed between the roll and the conductors and may cover the region between the grooves. The dielectric layer may be fabricated of anodized aluminum or a polymer and may be applied by spraying, dipping or powder spraying. The roll is made from a conductive material such as aluminum and the dielectric layer is disposed about the circumferential surface of the roll between adjacent grooves. The conductive material is applied to the grooves by a coater to form the electrical conductors. A charge relaxable layer is applied over the donor roll surface.

U.S. Pat. No. 4,868,600 discloses a scavengeless development system in which toner detachment from a donor and the concomitant generation of a controlled powder cloud is obtained by AC electrical fields supplied by self-spaced electrode structures positioned within the development nip. The electrode structure is placed in close proximity to the toned donor within the gap between toned donor and image receiver, self-spacing being effected via the toner on the donor.

U.S. Pat. No. 3,996,892 discloses a donor roll having an electrically insulating core made of a phenolic resin. The donor roll core is coated with conductive rubber doped with carbon black. Conductor strips are formed on the rubber by a copper cladding process followed by a photo-resist-type etching technique.

U.S. Pat. No. 3,980,541 discloses composite electrode structures including mutually opposed electrodes spaced apart to define a fluid treatment region. Resistive electrodes serve to localize the effects of electrical shorts between electrodes. Non-uniform sheet and filamentary electrodes are disclosed for producing a substantially non uniform electric field.

U.S. Pat. No. 3,257,224 discloses a developing apparatus including a trough to contain magnetizable developer and a magnetic roller. The roller transports the developer to an electrophotographic material and includes plates having a number of windings. The plates and windings are located inside the roll. The plates and windings serve as electromagnets to magnetically attract the developer so that it may be transported to the material.

SUMMARY OF THE INVENTION

According to the present invention there is provided a donor roll for transporting marking particles to an electrostatic latent image recorded on a receiving surface. The donor roll is adaptable for use with an electric field to assist in transporting the marking particles from the donor roll to a development zone adjacent the receiving surface. The donor roll includes a rotatably mounted body and a first electrode member mounted on the body. The donor roll further includes a second electrode member mounted on the body and spaced from the first electrode member and a resistive member electrically interconnecting the first electrode member and the second electrode member so that when an electrical potential is applied to the first electrode member a portion of the potential will be transferred to the second electrode member.

According to the present invention, there is also provided a developer unit for developing a latent image recorded on an image receiving member to form a developed image. The developer unit is adaptable for use with an electric field to assist in developing the latent image. The developer unit includes a housing defining a chamber for storing at least a supply of marking particles therein and a movably mounted donor member. The donor member is spaced from the receiving surface and adapted to transport marking particles from the chamber of the housing to a development zone adjacent the receiving surface. The donor member includes a body and a first electrode member mounted on the body. The donor member further includes a second electrode member mounted on the body and spaced from the first electrode member, and a resistive member electrically interconnecting the first electrode member and the second electrode member so that when an electrical potential is applied to the first electrode member a specified portion of that potential will be transferred to the second electrode member.

According to the present invention, there is further provided an electrophotographic printing machine of the type having a developer unit adapted to develop with marking particles an electrostatic latent image recorded on an image receiving member. The developer unit is adaptable for use with an electric field to assist in developing the latent image. The improvement includes a housing defining a chamber for storing at least a supply of marking particles in the chamber and a movably mounted donor member. The donor member is spaced from the receiving surface and adapted to transport marking particles from the chamber of the housing to a development zone adjacent the receiving surface. The donor member includes a body and a first electrode member mounted on the body. The donor member further includes a second electrode member mounted on the body and spaced from the first electrode member, and a resistive member electrically interconnecting the first electrode member and the second electrode member so that when an electrical potential is applied to the first electrode member a specified portion of that potential will be transferred to the second electrode member.

IN THE DRAWINGS

The invention will be described in detail herein with reference to the following figures in which like reference numerals denote like elements and wherein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 2 printing machine will be shown hereinafter schematically and their operation described briefly with reference thereto.

Figure 2:
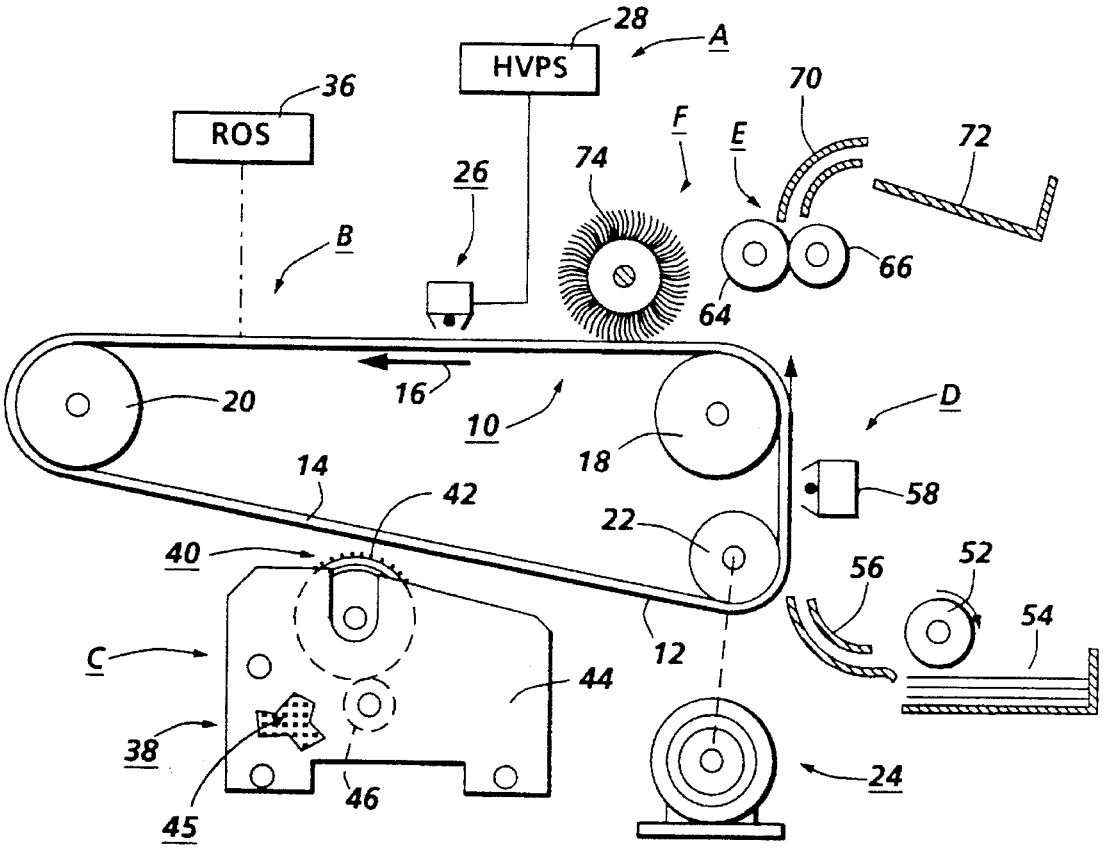
FIG. 2 is a schematic elevational view of printing machine incorporating the resistive network commutation segmented donor roll of FIG. 1.

Referring initially to FIG. 2, there is shown an illustrative electrophotographic printing machine incorporating the development apparatus of the present invention therein. The printing machine incorporates a photoreceptor 10 in the form of a belt having a photoconductive surface layer 12 on an electroconductive substrate 14. Preferably the surface 12 is made from a selenium alloy or a suitable photosensitive organic compound. The substrate 14 is preferably made from a polyester film such as Mylar® (a trademark of Dupont (UK) Ltd.) coated with a thin layer of aluminum alloy which is electrically grounded. The belt is driven by means of motor 24 along a path defined by rollers 18, 20 and 22, the direction of movement being counter-clockwise as viewed in FIG. 2 and indicated by arrow 16. Initially a portion of the belt 10 passes through a charging station A where corona generator 26 charges surface 12 to a relatively high, substantially uniform, potential. A high voltage power source 28 supplies current to generator 26.

Subsequent to charging, photoconductive surface 12 is advanced through exposure station B where raster output scanner (ROS) 36 exposes the surface 12 in a raster pattern consisting of a series of horizontal scan lines with each line having a specified number of pixels per inch. The ROS includes a laser source controlled by a data source, a rotating polygon mirror, and optical elements associated therewith. The ROS exposes the charged photoconductive surface 12 point by point to generate the latent electrostatic image to be printed. It will be understood by those familiar with the art that alternative exposure systems for generating the latent electrostatic image, such as liquid crystal light valve and light emitting diode print bars, or a conventional light lens arrangement could be used in place of the ROS system.

After the electrostatic latent image has been recorded on photoconductive surface 12, belt 10 advances the latent image to development station C as shown in FIG. 2. At development station C, a development system 38 develops the latent image recorded on the photoconductive surface. Preferably, development system 38 includes one or multiple donor rolls or rollers 40 incorporating electrical conductors in the form of electrode wires or electrodes 42 in the gap between the donor roll 40 and photoconductive belt 10. Electrodes 42 are electrically activated with high voltage AC potentials to detach charged toner particles from the roll surface and form a toner powder cloud in the gap between the donor roll and photoconductive surface. The latent image attracts the charged toner particles from the toner powder cloud developing a visible toner powder image thereon. Donor roll 40 is mounted, at least partially, in the chamber of developer housing 44. The chamber in developer housing 44 stores a supply of two-component developer material 45 consisting of at least magnetic carrier granules having toner particles adhering triboelectrically thereto. A transport roll or roller 46 disposed wholly within the chamber of housing 44 conveys the developer material to the donor roll 40. The transport roll 46 is electrically biased relative to the donor roll 40 so that the toner particles are attracted from the transport roller to the donor roll.

Again referring to FIG. 2, after the electrostatic latent image has been developed, belt 10 advances the developed image to transfer station D, at which a copy sheet 54 is advanced by roll 52 past guides 56 into contact with the developed image on belt 10. Corona generator 58 deposits ions on the back surface of sheet 54 to attract the developed toner image from the surface of belt 10 to the surface of copy sheet 54. As belt 10 passes over roller 18, copy sheet 54 with the transferred toner image is stripped from the belt surface.

After transfer, the sheet is advanced by a conveyor (not shown) to fusing station E. Fusing station E includes a heated fuser roller 64 and a back-up roller 66. Copy sheet 54 passes between fuser roller 64 and back-up roller 66 with the toner powder image contacting the surface of fuser roller 64. In this way, the toner powder image is permanently affixed to the surface of copy sheet 54. After fusing, the copy sheet advances through chute 70 to catch tray 72 for subsequent removal from the printing machine by the operator.

After copy sheet 54 is stripped from the surface of belt 10, residual toner particles adhering to photoconductive surface 12 are removed at cleaning station F by a rotating fibrous brush 74 in contact with photoconductive surface 12. Subsequent to cleaning, a discharge lamp (not shown) floods photoconductive surface 12 with light to dissipate any residual electrostatic charge prior to recharging photoconductive surface 12 for the next successive imaging cycle.

It is believed that the foregoing description is sufficient for purposes of the present application to illustrate the general operation of an electrophotographic printing machine incorporating the development apparatus of the present invention.

Figure 3:
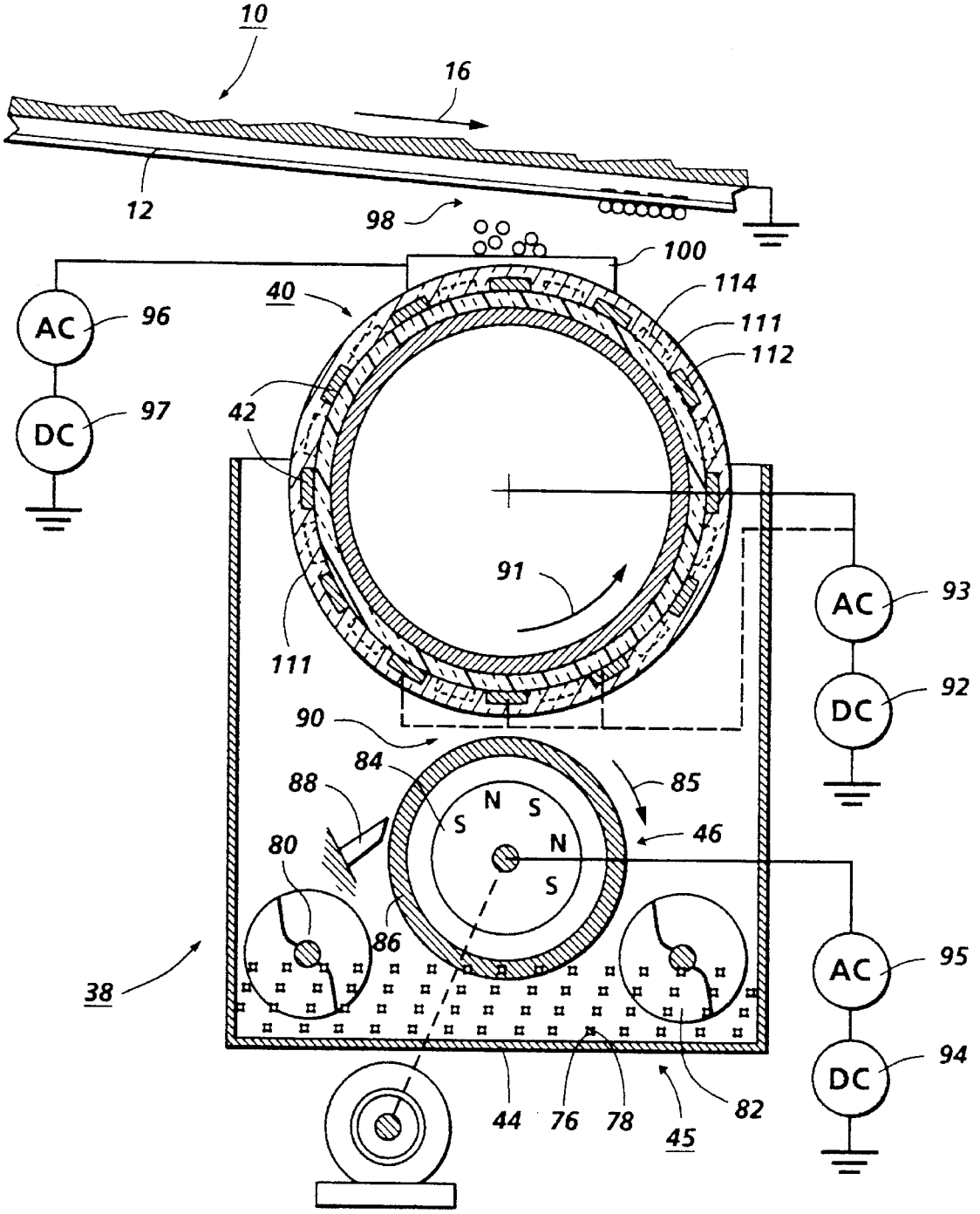
FIG. 3 is a schematic elevational view of development unit incorporating the resistive network commutation segmented donor roll of FIG. 1.

Referring now to FIG. 3, there is shown development system 38 in greater detail. Housing 44 defines the chamber for storing the supply of developer material 45 comprised of carrier granules 76 with triboelectrically adhered toner particles 78. Augers 80 and 82 distributes developer material 45 uniformly along the length of transport roll 46 in the chamber of housing 44.

Transport roll 46 consists of a stationary multi-pole internal magnet 84 having a closely spaced sleeve 86 of non-magnetic material designed to be rotated about the body of magnet 84 in a direction indicated by arrow 85. Developer material in the form of magnetic carrier beads or granules 76 charged with toner particles 78 are attracted to the exterior of the sleeve 86 as it rotates through the stationary magnetic fields of magnet 84. A doctor blade 88 meters the quantity of developer adhering to sleeve 86 as it is transported to loading zone 90, the nip between transport roll 46 and donor roll 40. This developer material adhering to the sleeve 86 contains magnetic carrier beads that form a filamentary structure commonly referred to as a magnetic brush.

The donor roll 40 includes electrodes 42 in the form of axial conductive elements spaced evenly around its peripheral circumferential surface. The electrodes are preferably positioned at or near the circumferential surface and may be applied by any suitable process such as photolithography, electroplating, laser ablation, silk screening, or direct writing. It should be appreciated that the electrodes may alternatively be delineated by axial grooves (not shown) formed in the periphery of the roll 40. The electrical conductors 42 are substantially spaced from one another and are typically formed on an insulating shell or non conductive layer applied over the core of donor roll 40 which may be electrically conductive.

In one architectural embodiment of the present invention, every other electrode is connected to a common electrical bus, typically located at one end of the roll. Collectively these electrodes are referred to as common electrodes 114. The remaining electrodes are referred to as active electrodes 112 which may be operated as independent elements or connected in groups of 2 to 4 electrodes with all groups around the roll circumference having the same number of electrodes.

Overcoating layer 111 covering those portions of roll 40 that interact with charged toner preferably consists of a material which has very low electrical conductivity, but is not totally insulating. The conductivity of this material must be low enough to behave as a blocking layer in order to suppress electrical breakdown between adjacent electrodes, as well as prevent short circuits or electrical discharges between the electrode elements and the conductive filaments of the magnetic brush in loading zone 90. However, this material must be sufficiently conductive to provide a well defined average surface potential that defines the DC development zone fields in the gap between the donor roll 40 and photoconductive belt 10 in spite of charge exchange at the donor roll surface.

Common electrodes 114 are biased at a specific average voltage with respect to system ground by a direct current (DC) voltage source 92. An alternating current voltage source 93 may also be connected to the common supply circuit to provide an AC voltage component to common electrodes 114.

Transport roll 46 is also biased at a specific voltage with respect to system ground by a DC voltage source 94, with optional voltage source 95 providing an AC voltage component to the transport roll 46.

By controlling the output potentials of DC voltage sources 92 and 94, the DC electrical field strength applied in loading zone 90 between the magnetic brush filaments and the donor roll surface is defined. When the electric field between these members is of the correct polarity and of sufficient magnitude, toner particles 78 migrate from the magnetic brush filament tips and form a self-leveling layer of toner particles on the surface of donor roll 40. This development mechanism is confined to the area denoted as the loading zone 90.

By controlling the amplitude, frequencies, and phases of the AC voltage sources 93 and 95, the AC electrical field applied between the donor roll surface and the magnetic brush filaments on rotating sleeve 86 of magnetic roll 46 can be optimized. The application of the AC electrical field across the magnetic brush is known to improve uniformity and enhance the rate at which toner deposits on the surface of the donor roll 40.

It is believed that the application of an AC electrical field component in loading zone 90 helps break the cohesive and electrostatic bonds between toner particles and carrier beads, statistically softening the threshold for migration of the toner particles to the donor roll surface under the action of the DC electrical field.

In the loading zone, it is desirable that the active electrodes 112 and common electrodes 114 be operated at the same potential. In this case both the active and common electrodes would be driven by voltage sources 92 and 93 while passing through the loading zone.

While the development system 38 as shown in FIG. 3 utilizes both DC voltage source 92 and AC voltage source 93 to supply common electrodes 114, as well as transport roller DC voltage source 94 and AC voltage source 95, the invention may be practiced, with merely DC voltage source 92 supplying common electrodes 114 on donor roll 40.

It has been found that an AC voltage amplitude of about 200 V rms applied across the magnetic brush between the surface of the donor roll 40 and the sleeve 86 is sufficient to maximize the loading/reloading rate of donor roll 40. That is the delivery rate of toner particles from the magnetic brush to the donor roll surface is maximized. In any specific example, the optimum voltage amplitude depends on the reloading zone geometry and can be adjusted empirically. In theory, any value can be applied up to the point at which discharge occurs within the magnetic brush. For typical developer materials, donor roll to transport roll spacings, and material packing fractions, this maximum value is on the order of 400 V rms at an AC frequency of about 2 kHz. If the frequency is too low, e.g. less than 200 Hz, image density banding visible to the eye can be seen on the copies due to the periodic variation of toner delivered by the donor roll. If the frequency is relatively high, e.g. more than 15 kHz, the toner migration rate is enhanced, but the AC high voltage supplies must deliver much higher capacitive load currents and consequently cost more to manufacture and can cause more inadvertent damage in the case of a momentary breakdown.

Donor roll 40 rotates in the direction of arrow 91. The relative voltages between the common electrodes 114 and active electrodes 112 of donor roll 40, and the sleeve 86 of magnetic roll 46 are selected to provide efficient loading of toner from the magnetic brush onto the surface of the donor roll 40. AC and DC electrode voltage sources 96 and 97 respectively, are arranged to electrically energize active electrodes 112 in sequence as donor roll 40 rotates in the direction of arrow 91, and successive active electrodes 112 advance into development nip 98 between the donor roll 40 and the photoreceptor belt 10.

As shown in FIG. 3, according to the present invention, a resistive network commutator 100 connected to electrode voltage sources 96 and 97 distributes AC excitation potentials in timed sequence to active electrodes 112 as they advance into development nip 98 due to the rotation of donor roll 40 in the direction of arrow 91. In this way, a large AC voltage difference is applied between adjacent active electrodes 112 and common electrodes 114 supplying strong oscillating electric fields in a narrow zone at the surface of donor roll 40 that detach toner from the donor roll surface and form a localized toner powder cloud.

The construction and geometry of a segmented donor roll is described in detail in U.S. Pat. Nos. 5,172,259 to Hays et al., 5,289,240 to Wayman, and 5,413,807 to Duggan the relative portions thereof incorporated by reference herein.

The applicants have determined that the required AC activation potential for the formation of a well defined toner cloud on donor roll 40, with longitudinal interdigitated common electrodes 114 and active electrodes 112 both approximately 0.004 inches wide and spaced approximately 0.005 inches apart around the periphery of the donor roll 40, is approximately 1000 to 1,300 volts at 3 khz.

Figure 1:
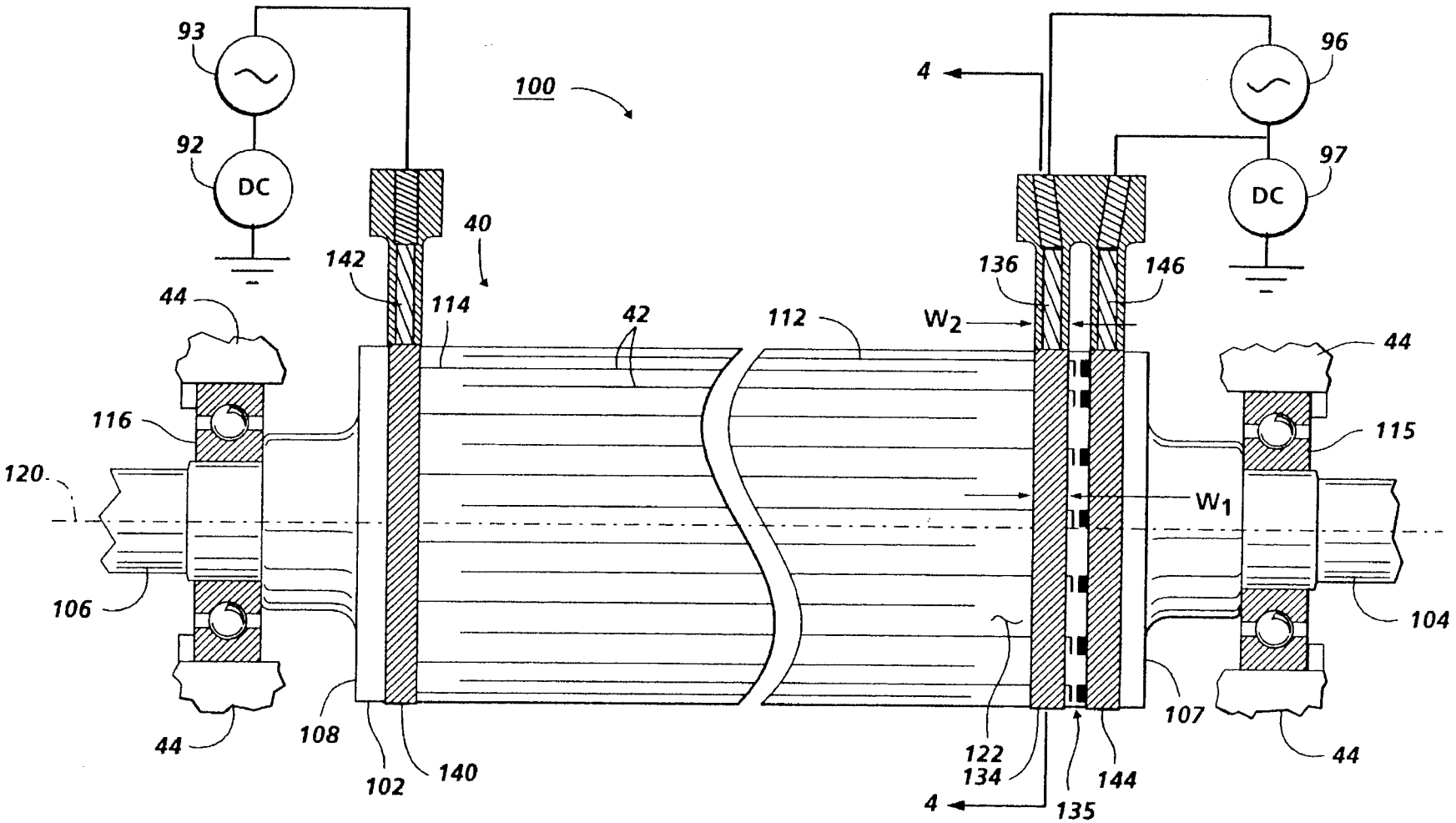
FIG. 1 is an elevational view of a first embodiment of a resistive network commutation segmented donor roll of the present invention.

According to the present invention and referring to FIG. 1, the resistive network commutator 100 on donor roll 40 is shown in greater detail. The donor roll 40 is made of any suitable durable material, for example, a ceramic rod or tube, or a polyamide sleeve bonded over a rigid metal shaft. The donor roll 40 includes a body 102 from which first journal 104 and second journal 106 extend from first end 107 and second end 108, respectively, of the body 102 of donor roll 40. The donor roll 40 may be supported by any suitable method, for example, as shown in FIG. 1, by first and second bearings 115 and 116 mounted in bearing pockets in developer housing 44 and supporting the first and second journals 104 and 106, respectively. Periphery 122 of donor roll 40 is patterned with an array 42 of narrowly-spaced conductive electrode elements parallel to axis 120 of donor roll 40. Electrode array 42 comprises the active electrodes 112, which are electrically activated in timed sequence via distribution through resistive network commutator 100 from fixed electrical contact brush 136 supplied by power sources 96 and 97, slip ring 144 supplied by DC power source 97, and the common electrodes 114 supplied by voltage sources 92 and 93.

Within electrode array 42, active electrodes 112 and common electrodes 114 are arranged in an interdigitated pattern, that is, each common electrode 114 is positioned between adjacent active electrodes 112 and vice versa over the central clouding portion of donor roll 40. The active electrodes 112 are activated by the currents distributed by resistive members 134 and 135 of resistive network commutator 100. Resistive members 134 and 135 may be discrete components, or fabricated according to thin film or thick film methods known to those skilled in the hybrid electronic circuit art using any suitable material having the proper geometry and sheet resistivity preferably in the range of a few kOhms per square to a few megOhms per square.

For example, resistive members 134 may be as shown in FIG. 1 in the form of the interelectrode segments formed by a narrow ribbon of electrically resistive material deposited over the active electrodes 112 on the surface of the donor roll 40. Alternatively, the active electrodes 112 may be formed after the resistive layer is deposited on the surface of the donor roll so that the electrodes defining the boundaries of resistive members 134 are fully exposed.

The layer forming resistive members 134 is preferably in the form of a circumferential band or ribbon having a width $W_1$ approximately equal to or slightly larger than the width $W_2$ of a first electrically contacting brush 136, in order to provide for easy mechanical alignment of the brush with respect to the resistive ribbon. For example, the width $W_1$ may be in the range of approximately 1 to 5 mm. Brush 136 makes uninterrupted wiping contact with the surface of resistive layer 134 and is electrically driven by power sources 96 and 97.

Resistive layer 134 may, for example, be formulated from a polyamide based matrix in the form of a thick film resistive ink which is compatible with a body 102 made of Kapton®, a product of DuPont (UK) Ltd. A wide range of commercial resistive and conductive polymer thick film inks used in the fabrication of hybrid electronic circuits are readily available. Inks with a sheet resistivity in the range of a few milliOhms to a few hundred Ohms per square can be utilized to construct both sets of individual conductive electrodes 112 and 114, as well as electrical slip rings 140 and 144, and a similar ink formulated to yield a resistivity of several megOhms per square can be used to deposit the resistive ribbon from which resistive members 134 and 135 are formed. Alternatively, the network components may be made of more robust commercially available Ruthenium and noble metal-based cermet thick film hybrid microelectronic materials designed to be fired on high temperature over ceramic substrates.

Electrically contacting Brush 136 may be made of any suitable durable material, for example, a pultruded carbon impregnated plastic, solid and bifurcated graphite, a metal contact array, a strip of high conductivity polyamide resistor material on a Kapton® spring, a taught contacting ribbon of low resistance material that is tangent to the contact area, a polyamide or conductive elastomer in the form of a blade cleaner or doctor blade, a scrubbing contact or a snowplow contact which may provide improved surface cleaning of the electrical contact area. In each case the energizing currents are distributed to the active electrodes in the appropriate ratios by the rotating resistive network on the donor roll surface, whereas the brush functions only as an uninterrupted electrical contact with minimal internal resistance. This is an improvement on earlier designs where an extended brush with graded internal resistivity is required to provide a tailored energizing current profile.

Figure 4:
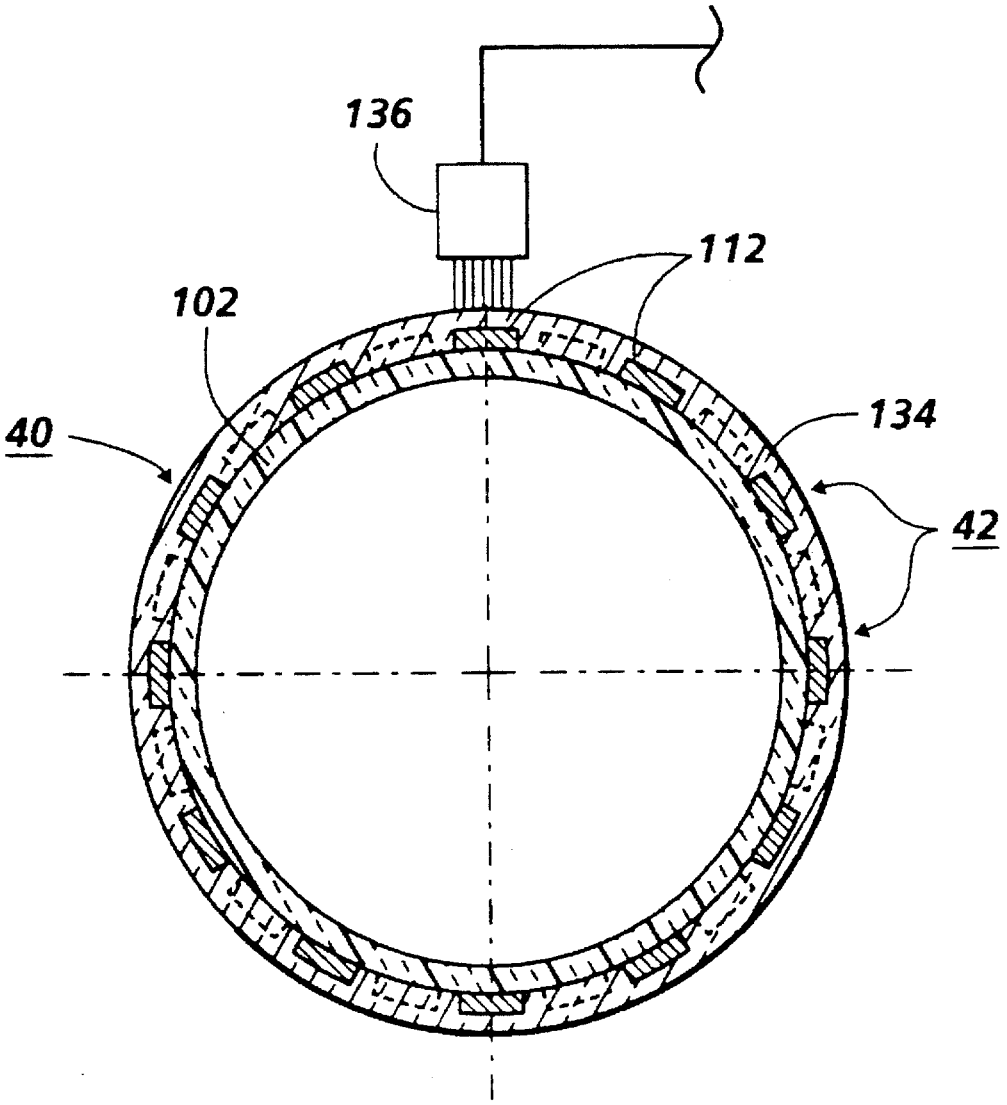
FIG. 4 is a partial sectional view in the direction of arrows 4—4 of the resistive network commutation segmented donor roll of FIG. 1.

Referring now to FIG. 4, the donor roll 40 includes the body 102 on which the resistive ribbon forming elements 134 are deposited to make electrical contact with the active electrodes 112 of electrode array 42. As donor roll 40 rotates, brush 136 makes uninterrupted electrical contact with the exposed surface of resistive layer 134.

Referring again to FIG. 1, resistive layer 134 is positioned near the first end 107 of donor roll 40. The common electrodes 114 are in Ohmic contact with slip ring 140 which circumferentially extends around the periphery of donor roll 40. Slip ring 140 may be made of any suitable durable electrically conductive material such as a noble metal alloy, but is preferably fabricated using a hybrid electronic circuit thick film ink with sheet resistivity below about 100 Ohms per square. A second conductive brush 142 makes uninterrupted electrical contact with the surface of slip ring 140 and provides an unbroken electrical path to power sources 92 and 93. The second brush 142 may be of any suitable electrically conductive material and may be identical to brush 136 in both material and design. A second electrical slip ring 144 is positioned in close proximity to the ribbon of resistive members 134 and 135 circumferentially extending around the periphery of donor roll 40. Except for its position adjacent to resistive members 134, slip ring 144 may be identical to slip ring 140 in both material and method of application. A third conductive brush 146 makes uninterrupted electrical contact with the surface of slip ring 144 and provides electrical continuity to power sources 96 and 97. All three brushes 136, 142, and 146 may be of any suitable electrically conductive material and may be identical in both material and design.

Figure 5:
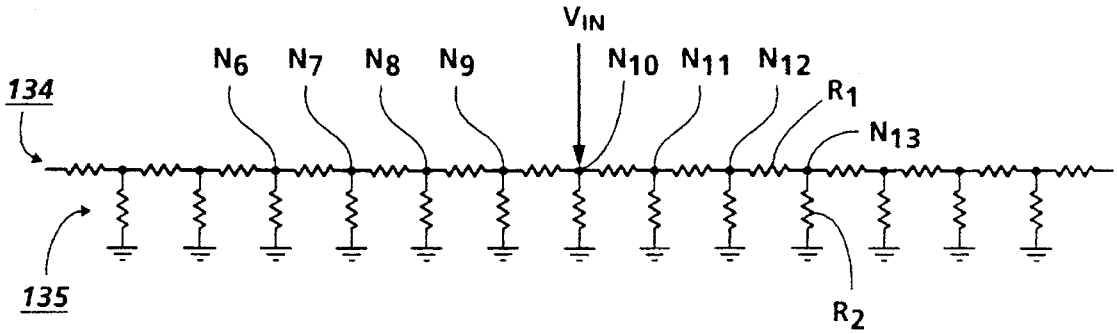
FIG. 5 is a simplified electrical circuit diagram of the resistive network commutation segmented donor roll of FIG. 1.

Referring now to FIG. 5, a simplified equivalent circuit of the network of resistive elements 134 and 135 is shown. Voltage $V_{IN}$ represents the nominal AC component of excitation voltage delivered from power source 97 (see FIG. 1) and applied to the surface of the resistive ribbon at the point of contact with the conductive brush 136. Resistance $R_1$ represents the value of individual resistive elements 134, and resistance $R_2$ represents the value of individual resistive elements 135. Node $N_{10}$ represents the electrode 112 making Ohmic contact with brush 136 and is therefore at the same voltage as delivered by the power source 96. Nodes $N_9$ and $N_{11}$ represent the active electrodes 112 immediately adjacent to the electrode in contact with the brush. Nodes $N_8$ and $N_{12}$ represent the active electrodes 112 displaced one step further from the electrode in Ohmic contact with brush 136.

Figure 6:
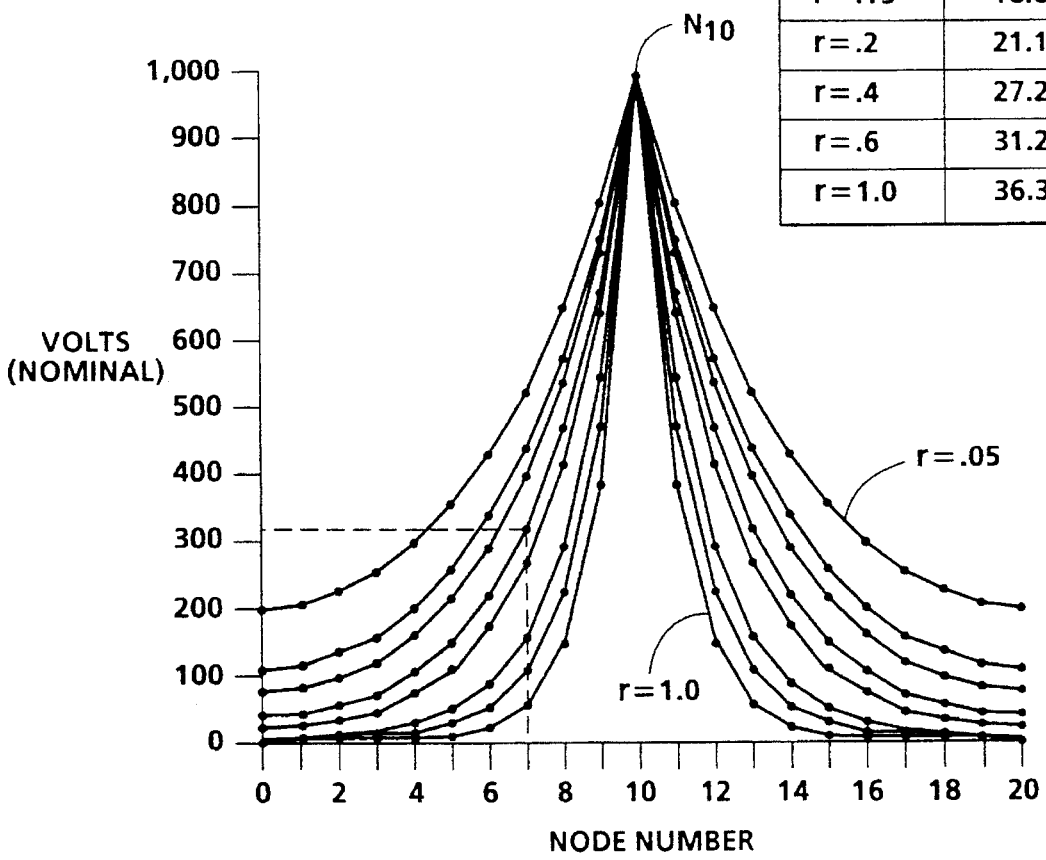
FIG. 6 is a graph of the voltages appearing on the electrodes of the resistive network commutation segmented donor roll of FIG. 1.

Referring now to the graph of FIG. 6, the distribution of node voltages indicating the AC potential amplitudes distributed to the nodes in FIG. 4 is plotted versus the node position, with node $N_{10}$ representing the electrode in contact with the brush. Plots of the voltages at each node are shown for each of several resistance ratios, from r=0.05 to r=1.0. The plot is symmetric and assumes that only node $N_{10}$ is supplied power. It should be appreciated that it may be advantageous to have a plurality of adjacent nodes supplied with power in which case the distribution of potentials for the remaining nodes is the same as shown in the plot. The resistance ratio is defined as follows:

$$r=R_1/R_2$$

Where:

$R_1$ is the resistance value of the ribbon segment of resistive layer 134 between adjacent active electrodes 112.

$R_2$ is the drain resistance providing a direct return current path to slip ring 144 for each active electrode 112.

Different combinations of resistive ink materials may be selected for the two resistances $R_1$ and $R_2$, and the ratio r may be further tailored as needed by choosing the geometry of the resistive segment between adjacent active electrode members 112, as well as the geometry of the resistive return path between each electrode and slip ring 144. In addition to the enormous range of basic resistive ink formulations available i.e., from a few Ohms to many gigOhms per square, sheet resistivity can be adjusted over a range of about 3:1 by varying the thickness of the deposition, and to a lesser degree, by adapting a non-standard curing cycle, i.e., overfiring or underfiring the deposited resistive materials at various peak temperatures and firing times. Lower values of the resistance ratio r result in more gradual changes in the applied voltage distribution as a result of commutation.

It can be seen from the plots in FIG. 6 for a resistance ratio r of 0.15, that a nominal input voltage $V_{IN}$ of 1,000 volts applied to node 10 for powder cloud formation results in nodes $N_9$ and $N_{11}$ having an effective applied voltage of approximately 681 volts. Likewise nodes $N_8$ and $N_{12}$, have an effective applied voltage of 464 volts, nodes $N_7$ and $N_{13}$ are effectively driven at 316 volts, and nodes $N_6$ and $N_{14}$ are driven at 216 volts. Rather than having the abrupt voltage vs. time profile of prior art commutating systems, the excitation voltage applied to each electrode of the present invention gradually increases as the electrode moves into the development zone and drops off in a symmetrical way as the electrode moves out of the development zone, thus providing the required high excitation voltage in the development zone while limiting the voltage differential between adjacent electrodes outside the zone.

Figure 7:
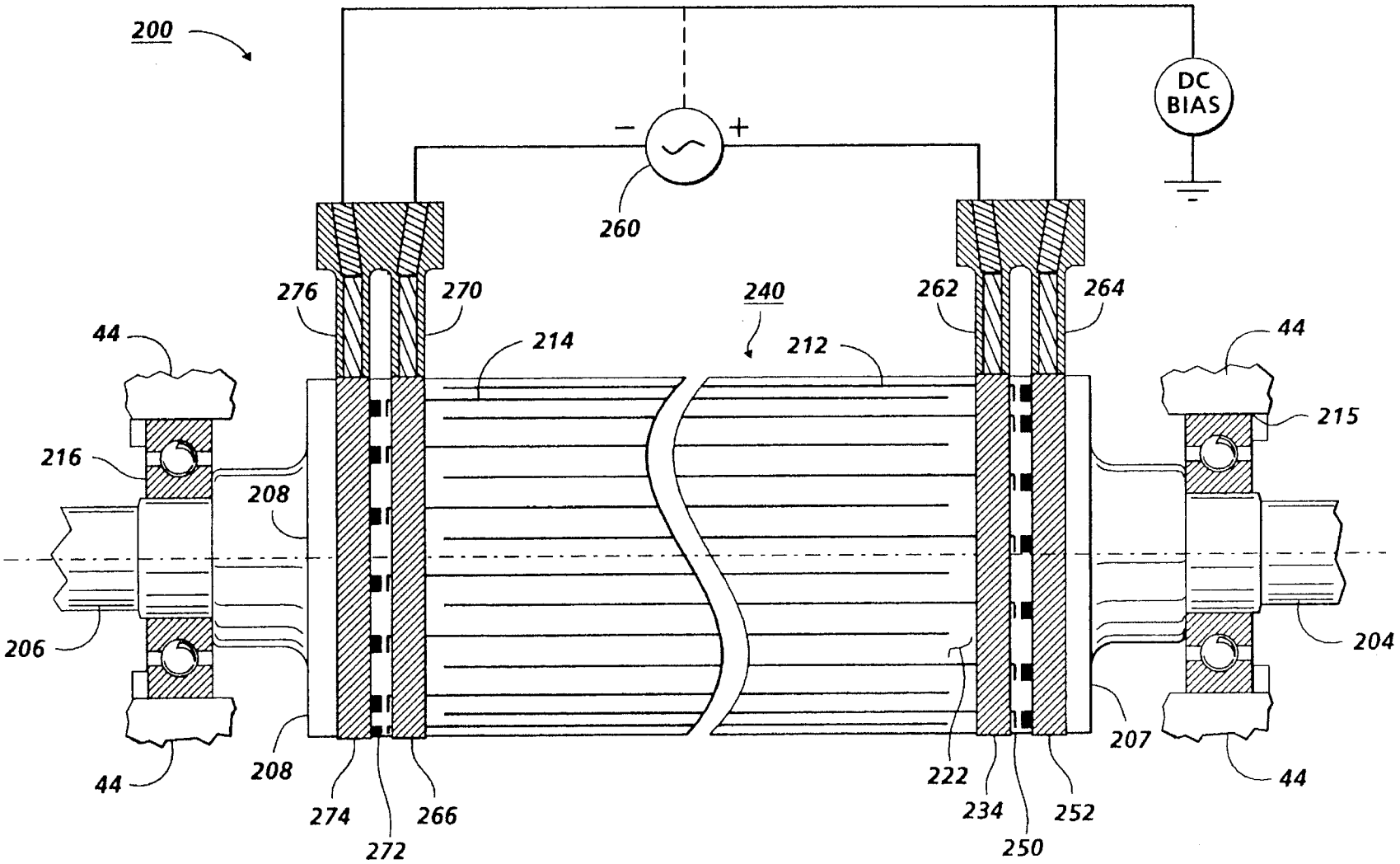
FIG. 7 is an elevational view of another embodiment of a resistive network commutation segmented donor roll of the present invention.

An alternate embodiment of the present invention is shown in resistive network commutator 200 of FIG. 7. Resistive network commutator 200 includes a donor roll 240 which is similar to donor roll 40 of FIG. 1 and is similarly supported by bearings 215 and 216 at first and second journals 204 and 206, respectively, extending outwardly respectively from first end 207 and second end 208 of the donor roll 240. First active electrodes 212 are similar to active electrodes 112 of FIG. 1 and are electrically connected to first resistive member 234 and to conductive slip ring 252 via second resistive member 250.

The first resistive member 234 is similar to resistive member 134 and is likewise, preferably, in the form of a resistive layer. The second resistive member 250 is electrically connected between electrodes 212 and conducting slip ring 252. The second resistive member 250 may take any suitable form as long as it provides the desired resistance ratio when combined in the resistive network with first resistive member 234, such as the r value of 0.15 as given in the previous example and shown in the graph of FIG. 6.

Referring again to FIG. 7, the second resistive member 250 is preferably in the form of a continuous circumferential band located adjacent to the first resistive member 234, on periphery 222 of the donor roll 240. Alternatively, second resistive member 250 may be more easily fabricated in the form of an array of separate discrete resistive elements forming resistive paths from each electrode 212 to the conductive slip ring 252. Preferably, the second resistive member 250 is made of a material similar in composition to that of the first resistive member 234 so that both may be processed in the same manufacturing steps.

The first resistive member 234 is electrically connected to power source 260 by any suitable means, for example, by a first conductive brush 262 which provides unbroken electrical contact with the first resistive member 234. Slip ring 252 is preferably in contact with second brush 264. Brushes 262 and 264 may have any suitable configuration and may, for example, be similar to first brush 136 of the donor roll 40 of FIG. 1 in both materials and design.

The second set of electrodes 214 unlike common electrodes 114 of the resistive network commutator 100 of FIG. 1, are electrically connected to a third resistive member 266 preferably in the form of a resistive layer similar to resistive member or layer 234. The third resistive member 266 is also supplied from power source 260, for example, by third conductive brush 270. Power source 260 provides a net DC bias voltage as well as two alternating voltage waveforms which are 180 degrees out of phase. One of these waveforms is applied to the first resistive member 234 via conductive brush 262 while the other waveform is applied to the third resistive member 266 via conductive brush 270 so that in addition to a common DC bias voltage, the voltage waveforms impressed on electrodes 212 and 214 are 180 degrees out of phase.

By applying two waveforms 180 degrees out of phase, total power dissipation in the resistive network can be significantly reduced without affecting the magnitude of the alternating electric fields between adjacent electrodes 212 and 214 responsible for creating and supporting a toner cloud. The applied voltage waveforms may be sinusoidal, square or more complex and are preferably symmetrical in that half of the net applied AC voltage is suppled to adjacent electrodes. The DC bias appears equally on both sets of electrodes and defines the average potential of the roll surface through the small but non-zero conductivity of the blocking layer (not shown).

Minimizing the total power dissipation in the resistive network helps lower operating temperatures and reduces the cost and size of the power supplies. In the toner reload zone, the alternating components of the applied potential supply 260 are highly attenuated, and both sets of electrodes 212 and 214 are biased at the common DC voltage applied to slip rings 252 and 274 via brushes 264 and 276. It should be noted that, by symmetry, if a conductive path is provided between slip rings 252 and 274 within the roll itself (not shown), the two rings will be established at the same DC bias voltage even if brushes 264 and 276 are omitted. Providing a direct connection from slip rings 252 and 274 to the bias voltage source is, however, good engineering practice.

The first resistive member 234 is located near the first end 207 of the donor roll 240, while the third resistive layer 266 is located adjacent the second end 208 of the donor roll 240. A fourth resistive member 272 is likewise preferably in the form of a resistive layer similar to second resistive member 250. A second conductive slip ring 274 is electrically connected to the fourth resistive member 272. The second conductive member 274 is preferably in the form of a slip ring similar to slip ring 252. Slip ring 274 is electrically contacted by fourth brush 276 and may be similar to second brush 264 in both materials and design. The second brush 264 and the fourth brush 276 are electrically connected to a common bias voltage source preferably as shown in FIG. 7.

Figure 8:
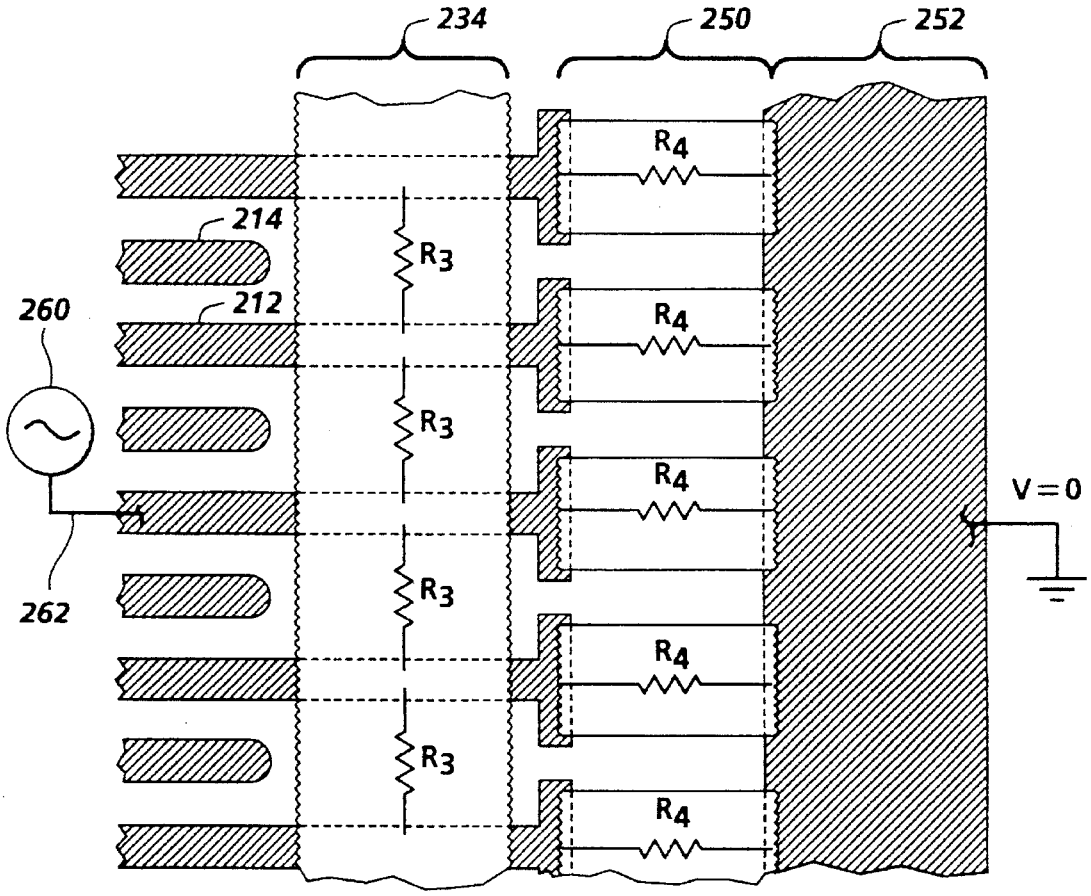
FIG. 8 is a partial schematic elevational view of the commutating portion of the donor roll of the resistive network commutation segmented donor roll of FIG. 1 employing lumped circuit elements.

Referring now to FIG. 8, the commutating area of commutator 200 is shown in greater detail. The first resistive member 234 is in Ohmic contact with all the first electrodes 212 in an area spaced apart from the ends of all second electrodes 214. The first resistive member 234 provides a continuous chain of equal resistors $R_3$ in the form of the interelectrode segments between adjacent electrodes 212 created when the narrow ribbon of electrically resistive material is deposited over the electrodes. The second resistive member 250 provides an array of individual well defined resistive paths between each electrode 212 and conductive slip ring 252, each path having resistance $R_4$. Since both the first resistive member 234 and the second resistive member 250 may each be independently fabricated from a wide range of basic resistive material formulations, and further refined as needed by choosing geometrical aspect ratios and thicknesses for the two resistive members, the values of $R_3$ and $R_4$ may be individually tailored for impedance range and power dissipation as well as the ratio yielding the best performance of the commutator 200.

Figure 9:
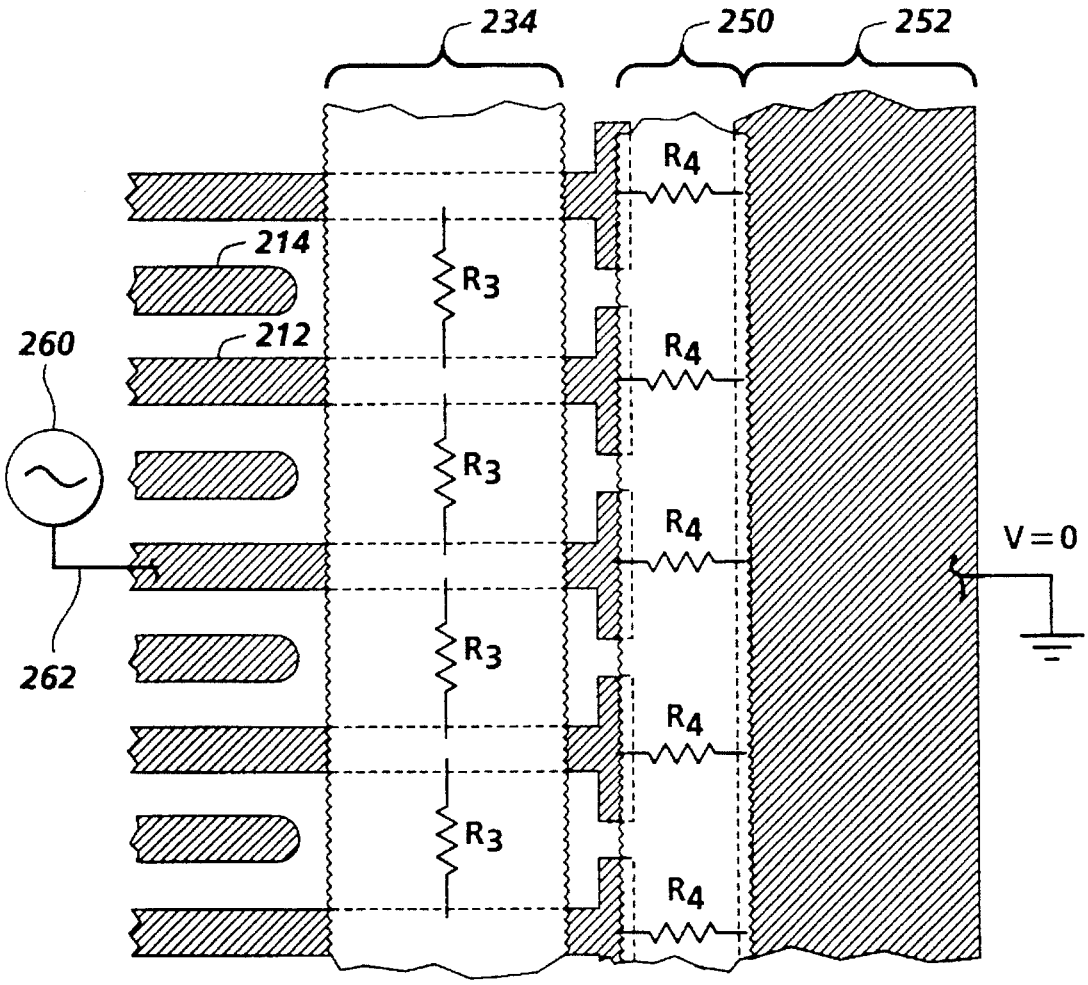
FIG. 9 is a partial schematic elevational view of the commutating portion of the donor roll of the resistive network commutation segmented donor roll of FIG. 1 employing continuous circuit elements.

Now referring to FIG. 9, resistive member 250 can be in the form of an unbroken resistive ribbon providing a resistive path between each electrode 212 and conductive slip ring 252 represented by equivalent circuit resistors $R_4$. It will be understood by those familiar with the art that the equivalent circuit resistors $R_3$ in the configuration of FIG. 8 will include a contribution from both elements 234 and 250 in parallel. In both FIG. 8 and 9, the DC bias has been omitted, power supply 260 is shown schematically connected to one electrode 212 representing the electrode node in contact with the brush, and slip ring 252 is shown grounded.

Figure 10:
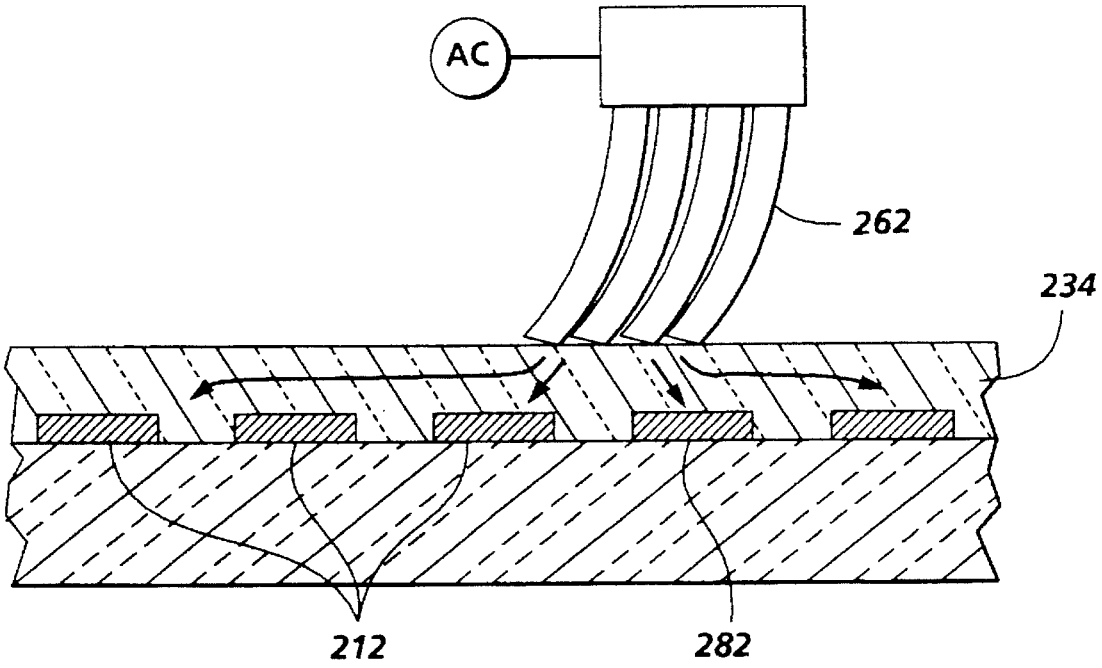
FIG. 10 is a schematic end view of the commutating portion of the donor roll of the resistive network commutation segmented donor roll of FIG. 7.

Now referring to FIG. 10, the path of brush 262 on the surface of resistive member 234 is shown in cross section to illustrate the internal distribution of current to conductive electrodes 212 formed on the surface of the donor rolls shown in FIGS. 1 and 7. In FIG. 10, the thickness of resistive layer 234 has been exaggerated for clarity to show the distribution of current paths within the layer. Note that in this view, electrodes 214 (see FIG. 7) do not extend beneath brush 262. Electrode 282 presents the most direct path to the contact point of brush 262, and hence receives proportionately more current than electrodes 212 positioned at greater distances from brush 262. As brush 262 passes over the surface of layer 234, each electrode 212 is excited in turn with the same AC amplitude envelope.

Figure 11:
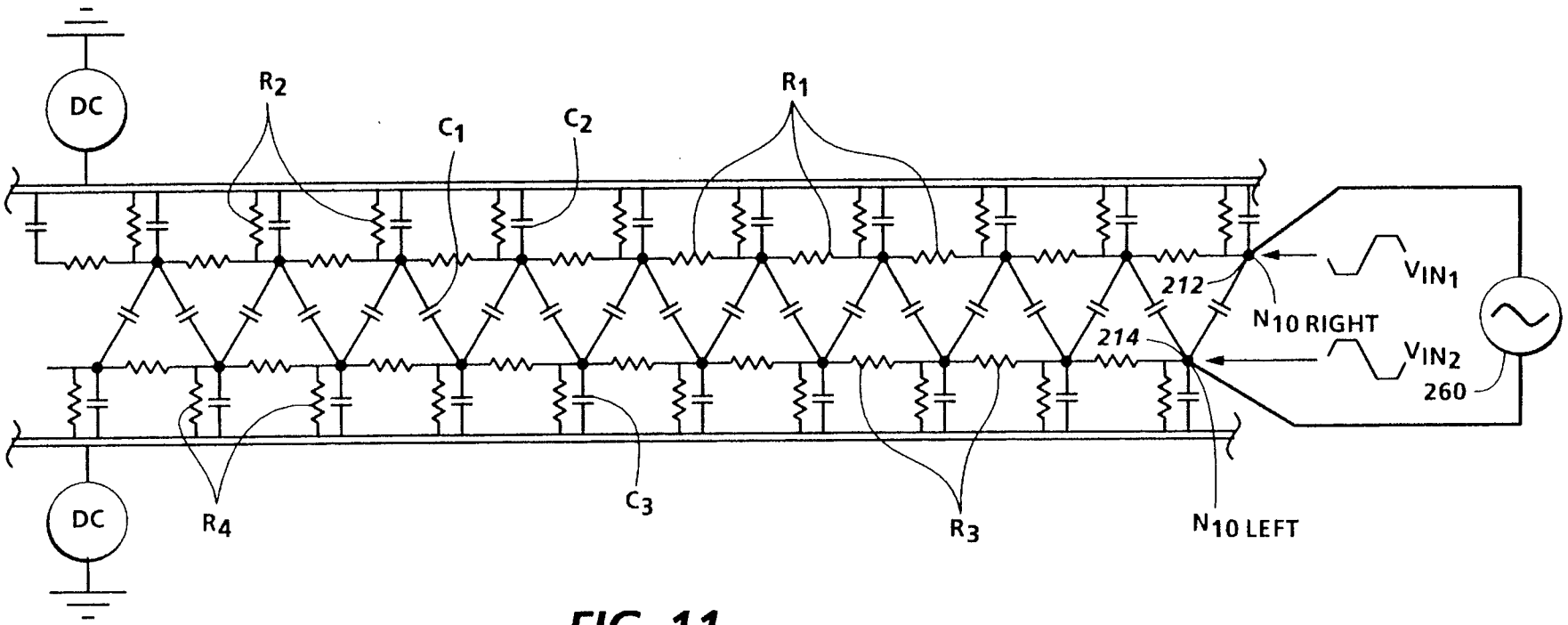
FIG. 11 is an electrical circuit diagram of the resistive network commutation segmented donor roll of FIG. 1.

Referring now to FIG. 11, an electrical diagram is shown schematically representing the electrical equivalent of the resistive network commutator 200 (see FIG. 7). Voltages $V_{IN+}$ and $V_{IN}$ represent the nominal excitation voltages delivered from power source 260 (see FIG. 7) and applied to nodes $N_{10left}$ and $N_{10right}$ representing the electrodes being contacted respectively by the first brush 262 and the third brush 270 shown in FIG. 7. Capacitors $C_1$ represent the interelectrode capacitance between adjacent electrodes 212 and 214. Resistors $R_1$ represent the resistance of the individual segments of first resistive member 234 between adjacent electrodes 212, while resistors $R_2$ represent the resistance between each electrode 212 and conductive member 252 (see FIG. 7). Resistors $R_3$ represent the resistance of the individual segments of second resistive member 266 between adjacent electrodes 214 while resistors $R_4$ represent the resistance between each electrodes 214 and conductive member 274 (see FIG. 7). Capacitors $C_2$ and $C_3$ represent the small but non-zero capacitance between each electrode and the roll substrate in FIG. 7. Under normal conditions it is expected that because the roll geometry is symmetric, capacitors $C_2$ and $C_3$ will be equal. The preferred design would preserve overall symmetry by fabricating resistors $R_1$ to match resistors $R_3$, and resistors $R_2$ to match resistors $R_4$.

By providing interdigitated electrodes with adjacent electrodes being supplied with electrical signals 180 degrees out of phase, the required voltage for powder cloud formation can be accomplished with a lower power consumption power supply.

By providing a pair of resistive layers, one to interconnect adjoining electrodes and second to connect the electrodes to a source of bias potential, a closely controlled electrical distribution can be obtained.

By providing a resistive network made of a polyamide based material, a low cost donor roll may be provided with superior performance and increased surface life. By providing a resistive network made of a ruthenium based material upon a ceramic substrate, an inexpensive yet extremely tough donor roll may be provided.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

I claim:

1. A donor roll for transporting marking particles to an electrostatic latent image recorded on a surface, said donor roll adaptable for use with an electric field to assist in transporting the marking particles from said donor roll to a development zone adjacent the surface, said donor roll comprising:

a rotatably mounted body;

a first electrode member mounted on said body;

a second electrode member mounted on said body and spaced from said first electrode member; and a resistive member electrically interconnecting said first electrode member and said second electrode member so that when the electric field is applied to said first electrode member a portion of the field will be transferred to second electrode member.

2. A donor roll according to claim 1, wherein said resistive member comprises a layer of resistive material applied to a portion of said body.

3. A donor roll according to claim 1, wherein at least a portion of at least one of said first electrode member and said second electrode member is positioned between said body and said resistive member.

4. A donor roll according to claim 1, wherein said body has a first end and a second end thereof, said resistive member being located adjacent said first end of said body.

5. A donor roll according to claim 1, further comprising an electrical conductor mounted on said body, spaced from said first electrode member and said second electrode member and electrically connected to at least one of said first electrode member and said second electrode member by said resistive member.

6. A donor roll according to claim 5, wherein said electrical conductor comprises a commutating ring.

7. A donor roll according to claim 1, further comprising:

a third electrode member mounted on said body and spaced from said first electrode member and said second electrode member;

a fourth electrode member mounted on said body and spaced from said first electrode member, said second electrode member and said third electrode member; and a second resistive member electrically interconnecting said third electrode to said fourth electrode member.

8. A donor roll according to claim 1, wherein said resistive member has a resistance of approximately 100,000 to 100,000,000 ohms per square unit of surface.

9. A developer unit for developing a latent image recorded on on a surface of an image receiving member to form a developed image, said developer unit adaptable for use with an electric field to assist in developing the latent image, said developer unit comprising:

a housing defining a chamber for storing at least a supply of marking particles therein; and a movably mounted donor member spaced from the surface and adapted to transport marking particles from the chamber of said housing to a development zone adjacent the surface, said donor member including a body, a first electrode member mounted on said body, a second electrode member mounted on said body and spaced from said first electrode member, and a resistive member electrically interconnecting said first electrode member and said second electrode member so that when the electric field is applied to said first electrode member a portion of the field will be transferred to second electrode member.

10. A developer unit according to claim 9, wherein said resistive member comprises a layer of resistive material applied to a portion of said body.

11. A developer unit according to claim 9, wherein at least a portion of at least one of said first electrode member and said second electrode member is positioned between said body and said resistive member.

12. A developer unit according to claim 9, wherein said body has a first end and a second end thereof, said resistive member being located adjacent said first end of said body.

13. A developer unit according to claim 9, further comprising an electrical conductor mounted on said body, spaced from said first electrode member and said second electrode member and electrically connected to at least one of said first electrode member and said second electrode member by said resistive member.

14. A developer unit according to claim 13, wherein said electrical conductor comprises a commutating ring.

15. A developer unit according to claim 9, further comprising:

a third electrode member mounted on said body and spaced from said first electrode member and said second electrode member;

a fourth electrode member mounted on said body and spaced from said first electrode member, said second electrode member and said third electrode member; and a second resistive member electrically interconnecting said third electrode to said fourth electrode member.

16. A developer unit according to claim 9, wherein said resistive member has a resistance of approximately 100,000 to 100,000,000 ohms per square unit of surface.

17. An electrophotographic printing machine of the type having a developer unit adapted to develop with marking particles an electrostatic latent image recorded on an image receiving member to form a developed image, wherein the improvement comprises:

a housing defining a chamber for storing at least a supply of marking particles therein; and a movably mounted donor member spaced from the surface and adapted to transport marking particles from the chamber of said housing to a development zone adjacent the surface, said donor member including a body, a first electrode member mounted on said body, a second electrode member mounted on said body and spaced from said first electrode member, and a resistive member electrically interconnecting said first electrode member and said second electrode member so that when the electric field is applied to said first electrode member a portion of the field will be transferred to second electrode member.

18. A printing machine according to claim 17, wherein said resistive member comprises a layer of resistive material applied to a portion of said body.

19. A printing machine according to claim 17, wherein at least a portion of at least one of said first electrode member and said second electrode member is positioned between said body and said resistive member.

20. A printing machine according to claim 17, wherein said body has a first end and a second end thereof, said resistive member being located adjacent said first end of said body.

21. A printing machine according to claim 17, further comprising an electrical conductor mounted on said body, spaced from said first electrode member and said second electrode member and electrically connected to at least one of said first electrode member and said second electrode member by said resistive member.

22. A printing machine according to claim 21, wherein said electrical conductor comprises a commutating ring.

23. A printing machine according to claim 17, further comprising:

a third electrode member mounted on said body and spaced from said first electrode member and said second electrode member;

a fourth electrode member mounted on said body and spaced from said first electrode member, said second electrode member and said third electrode member; and a second resistive member electrically interconnecting said third electrode to said fourth electrode member.

24. A printing machine according to claim 17, wherein said resistive member has a resistance of approximately 100,000 to 100,000,000 ohms per square unit of surface.

* * * * *